US011225341B2

(12) United States Patent
Kristensen

(10) Patent No.: US 11,225,341 B2
(45) Date of Patent: Jan. 18, 2022

(54) METHOD, COMPUTER PROGRAM, AND MULTIFUNCTIONAL, MODULAR AND MOBILE MIXING AND PACKAGING PLANT

(71) Applicant: INVERSIONES HIKI6, S.L., San Ginés (ES)

(72) Inventor: Henrik Stamm Kristensen, San Ginés (ES)

(73) Assignee: INVERSIONES HIKI6, S.L., San Ginés (ES)

( * ) Notice: Subject to any disclaimer, the term of this patent is extended or adjusted under 35 U.S.C. 154(b) by 773 days.

(21) Appl. No.: 15/939,597

(22) Filed: Mar. 29, 2018

(65) Prior Publication Data

US 2018/0280899 A1 Oct. 4, 2018

(30) Foreign Application Priority Data

Mar. 30, 2017 (ES) ..... ES201700326

(51) Int. Cl.

| | |
|---|---|
| ***B01F 3/12*** | (2006.01) |
| ***B01F 3/22*** | (2006.01) |
| ***B65B 3/12*** | (2006.01) |
| ***B65B 3/30*** | (2006.01) |
| ***B65B 3/28*** | (2006.01) |
| ***B65B 65/00*** | (2006.01) |
| ***B65B 1/00*** | (2006.01) |

(52) U.S. Cl.

CPC ..... *B65B 1/00* (2013.01); *B65B 65/00* (2013.01)

(58) Field of Classification Search

CPC .. B65B 1/32; B65B 65/00; B65B 3/28; B65B 37/18; E01C 19/1072; A23N 17/00; B01F 3/2215

See application file for complete search history.

(56) References Cited

U.S. PATENT DOCUMENTS

2012/0151877 A1* 6/2012 Stamm Kristensen ..... B65B 65/003 53/411

* cited by examiner

*Primary Examiner* — Elizabeth Insler
(74) *Attorney, Agent, or Firm* — Arent Fox LLP

(57) ABSTRACT

Modular mobile mixing and packaging plant for powdery or granular products, comprising a carrying structure having dimensions suitable for being introduced in a standard shipping container and internally housing a receiving and manual weighing module, a material loading module, a mixing module, and a packaging module, wherein the mixing module comprises means for cooling and/or drying the mixture contained in said module.

12 Claims, 9 Drawing Sheets

FIG.3B
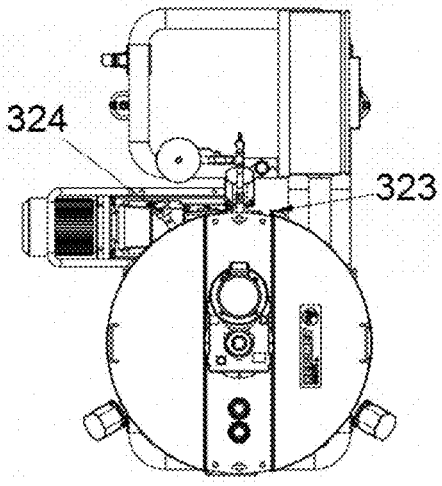
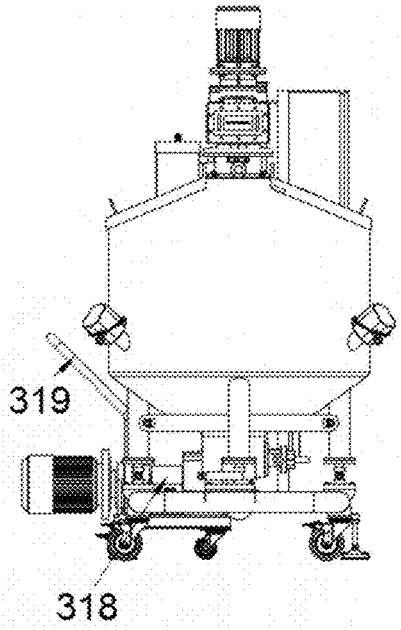
FIG.3C
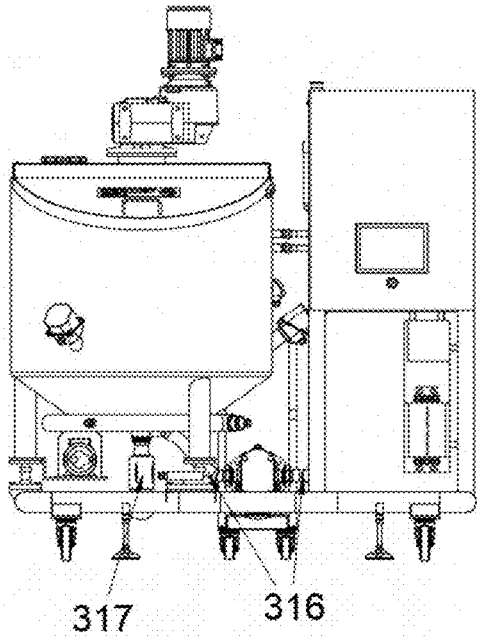
FIG.3D

METHOD, COMPUTER PROGRAM, AND MULTIFUNCTIONAL, MODULAR AND MOBILE MIXING AND PACKAGING PLANT

CROSS REFERENCE TO RELATED APPLICATION

This application claims priority of Spanish Patent Application No. 201700326 filed on Mar. 30, 2017, The content of which is hereby incorporated by reference in its entirety.

The object of the present invention is a method and a modular and easily transportable plant intended for dosing, mixing and packaging powdery products, granular products and other products having similar characteristics and comprising a carrying structure incorporating a plurality of modules interacting with one another to obtain a mixed and packaged product ready to be sold, and comprising as a main particularity the incorporation of cooling and drying means for cooling and drying the mixed product.

The present invention is comprised in the technical field of industrial plants for manufacturing, mixing and packaging powdery products such as those used in the agri-food industry, without this limiting the application thereof to other products having similar characteristics in other industrial manufacturing sectors.

STATE OF THE ART

Conventionally, in plants and machines for mixing powdery products different processing phases the product to be mixed goes through in the vertical direction, i.e., the product goes from one phase to another due to gravity, from the upper part of the plant to the lower part, are described, as is described, for example, in Spanish patent document with application number P0381423, which describes a machine for treating or mixing powdery products, granular products or doughy products.

To solve this problem, European patent document EP2465780 describes a mobile dosing, mixing and packaging plant which, as it can be a mobile plant capable of dosing, mixing and packaging powdery products, granular products or the like, can be transported in a certified shipping transport container measuring 40 feet, and where its entire structure, including all the necessary machinery, elements and tools, are distributed horizontally. Furthermore, this document describes a mobile plant the operative control of which is done remotely, assuring complete control over the product and the traceability thereof, being provided with real time connection with a control center arranged for such purpose in another location other than that of the mobile plant itself.

Nevertheless, the plant described in EP2465780 is not provided with cooling and drying means for cooling and drying the mixed product, so its functionality is limited. This is essentially because this patent only allows mixing powders, where it is desirable to perform processes of another type.

DESCRIPTION OF THE INVENTION

An object of the present invention is a method and a modular mobile plant which, based on concept described in patent document EP2465780, improves its functionality and modularity such that possible uses thereof and, therefore the versatility thereof, are increased, becoming a multifunctional plant. In that sense, the present invention describes a multifunctional plant that mixes products of any type, not just powdery products like in patent document EP2465780. The present invention also allows granulating mixed products.

A modular, mobile mixing and packaging plant for powdery or granular products comprising a carrying structure having dimensions suitable for being introduced in a standard shipping container and internally housing a receiving and manual weighing module, a material loading module, a mixing module and a packaging module, where there are incorporated automatic dosing modules for the automatic dosing prior to introducing the formula and furthermore incorporating an automatic formula loading module with an automatic bag opening system for automating the loading of raw material into the plant.

Furthermore, the mobile plant also incorporates a liquid injection module for injecting liquids into a powder mixture, maintaining a final powder state. The module is automated, such that it is possible to automatically dose the liquids into the mixture, up to ten liquids, according to what is previously required by the end user, with the ability to inject up to 50% liquid into the powder such that the powdery form is maintained after the injection with the conditions and parameters required by the final formulation, such as temperature, stirring and pre-mixture of liquids.

Finally, the plant incorporates a packaging module depending on the type of packaging the end user requires, including, in a non-limiting manner, a big bag bagging module, a European type bag bagging module or a module for bagging any other type of package (such as sachets, for example). Furthermore, the packaging module can incorporate an automatic palletizing module for any client needing end of line automation.

In all the described modules, a series of basic conditions are met to assure compatibility with the plant as a whole, because all the modules must be transportable in a maritime transport container measuring 20 or 40 feet, depending on the type of module, with all the necessary machinery, auxiliary elements and tools included.

On the other hand, the modules must be connectable plug and play type modules, i.e., they must be able to be connected with the CPU managing the plant as a whole for immediate use, which includes that the modules must be compatible both electrically and pneumatically.

In addition to the described modules, the multifunctional plant is most advantageous precisely because of the incorporation of means for cooling and/or drying the mixture in the mixing module, more specifically, the mechanical part of the mixer has been modified, utilizing its movements, to incorporate a flow of a fluid (preferably air) from the fixed mechanical part until extracting it through the involute of the lower part or lower side area of the container, all in an automated manner. In the present invention, it is essential to obtain air recirculation in the container, and particularly in the involute of the lower part thereof.

More specifically, the advantages of the solution described in the present invention are the following:

a) If in the equipment in the mixing position, for example, its position is rotated +180° (therefore inverting its position with respect to the horizontal defined by the floor of the plant), and a flow of a fluid (for example, dry air) is incorporated, the mixture of solids being processed will be dried. This furthermore makes the mixing container a fluidized bed dryer by means of drying using air flow, and as indicated, air recirculation in the involute of the lower part of the container.

b) If liquids are injected into the mixing container with said container in the horizontal position (i.e., at an angular position of 90° or 270° with respect to the horizontal defined by the floor of the plant) and blasts of air are furthermore provided with a specific screen-type agitator as a mixing tool for this new application, creating a suction current at the bottom of container, the so-called pelletizing or granulating operations can be performed.

c) If a mixture of solids with fats having a low melting point is processed in the equipment in which it is necessary to perform the mixture under controlled temperature and humidity conditions (where this operation is very delicate due to the temperature), it can be done by sending a cold fluid stream through the equipment and extracting it through the bottom of the container. The equipment therefore acts as a low-temperature cooler/mixer, even acting as equipment for cooling delicate solids such as fats. In this case, it must be taken into account that not only is the temperature important, but it is also necessary to take into account the humidity conditions of the air that is introduced in the container. Before the air is injected, it is sent through an air handling unit.

d) The equipment can, through an opening in the bottom in a fixed or variable position, connect the outlet of the container to vacuum equipment or a vacuum dryer, or it can be subjected to vacuum mixing to prevent possible mixtures, with there being oxygen, which invalidate the mixture. The equipment therefore acts as a vacuum dryer or vacuum mixer.

In summary, by adding automatic suction to the container and the fixed part of the installation, the mixing equipment therefore goes from being a mixer to being a (a) fluidized bed dryer; or (b) a pelletizer or granulator; or (c) a cooler; or (d) a vacuum dryer. The equipment of the present invention therefore becomes multifunctional equipment with this innovation.

The foregoing is described in the different aspects indicated in the independent claims attached to the present specification. In the same manner, the dependent claims show particular practical embodiments of the invention.

More specifically, in a first aspect of the invention the modular mobile mixing and packaging plant for powdery or granular products comprises a carrying structure having dimensions suitable for being introduced in a standard shipping container and internally housing a receiving and manual weighing module, a material loading module, a mixing module, and a packaging module, wherein the mixing module comprises means for cooling and/or drying the mixture contained in said module.

In a particular embodiment, the present invention incorporates at least one additional module selected from: an automatic liquid dosing and injection module or a big bag packaging module, wherein said additional modules can be inserted and be connected with a control PLC of the modular plant.

In another particular embodiment, the liquid injection module is configured for dosing liquid amounts of any viscosity into the mixing tank of the mixing module by means of a pump, with the flow rate thereof being controlled by means of a plurality of loading cells.

In another particular embodiment, the liquid injection module comprises a cylindrical liquid compartment with a frustoconical bottom and dual chamber prepared for introducing thermal oil distributing the heat of thermal resistors.

In another particular embodiment, the liquid compartment has a hygienic gantry where there is supported an agitator rotary support with agitator scrapers which are made of white, food-grade plastic and withstand service temperatures of 60° C. and peaks of up to 100° C.

In another embodiment of the invention, the liquid compartment comprises at least one inclined cover in the upper part.

In one embodiment of the invention, the liquid compartment comprises an outlet for the product with a sanitary bottom valve; and wherein upper openings will have safety sensors in at least one cover; and wherein each of the supports of the liquid compartment comprises a loading cell that allows reading the weight of the product.

In one embodiment of the invention, the liquid injection module comprises a heating system that carries out the function of keeping the product at the desired temperature, if required, by means of a dual chamber around the liquid compartment in which a thermal oil will circulate and in which thermal resistors will be installed; and wherein the outside of the liquid compartment is insulated.

In one embodiment of the invention, to load the thermal oil, the equipment has a compartment also acting as an expansion vessel, such that the oil enters a dual chamber of the liquid compartment where it is heated by means of thermal resistors; and wherein the outlet for the oil is located in the lower part, where there is a gear pump that continuously recirculates the thermal oil while it is hot through the oil circuit.

In another particular embodiment, the temperature of the product inside the liquid compartment and the temperature of the thermal oil are controlled by temperature probes.

In another particular embodiment, dosing is performed by means of a pump such that its inlet is connected to a bottom valve of the liquid compartment; and wherein the inlet of the pump is always below the outlet of the bottom valve.

In another particular embodiment, the big bag module (400) comprises: (a) a structure (401) capable of being introduced in a 20" container without deformations, protecting and providing support to the different auxiliary machines and equipment for performing the different processes; (b) receiving the mixed product in a hopper (402) and dosing for packaging; (c) a dosing valve (403) installed after the hopper (402) for dosing the already mixed product; (d) an in-line metal detector (404) with rejection means; and (e) a batch bagging module (405), with labeling and weight control (406).

In a second aspect of the invention, the method of mixing and packaging powdery or granular products in the modular mobile plant object of the invention comprises the steps of: receiving and manual weighing, loading material, mixing and packaging; and wherein said steps are controlled by a PLC remotely connected with a central server providing the instructions and orders for mixing and configuring the end product, and further comprising at least one step of drying and cooling the mixed product in the actual mixing module.

In a particular embodiment of the method of the invention, said method comprises at least one additional step selected from: automatic dosing, injecting liquids, and bagging; wherein said additional modules can be inserted and be connected with a control PLC of the modular plant.

Finally, a third aspect of the present invention claims a computer program with instructions configured for being executed by one or more processors, which instructions, when executed by the plant of the invention, causes said plant to carry out the method object of the present invention.

Throughout the description and claims the word "comprises" and variants thereof do not seek to exclude other technical features, additives, components, or steps. For those skilled in the art, other objects, advantages, and features of the invention will depend in part on the description and in part on putting the invention into practice. The following examples and drawings are provided by way of illustration and are not intended to limit the present invention. Furthermore, the present invention covers all the possible combinations of particular and preferred embodiments herein indicated.

BRIEF DESCRIPTION OF THE DRAWINGS

A series of drawings which help to better understand the invention and which are expressly related to an embodiment of said invention presented as a non-limiting example thereof is very briefly described below.

FIGS. 3A-3E show a liquid injection module (in isometric, plan, elevational, profile, and internal views respectively) which is connected with the mobile mixing plant for powdery products of FIG. 1.

DETAILED DESCRIPTION OF AN EMBODIMENT OF THE INVENTION

Figure 1:
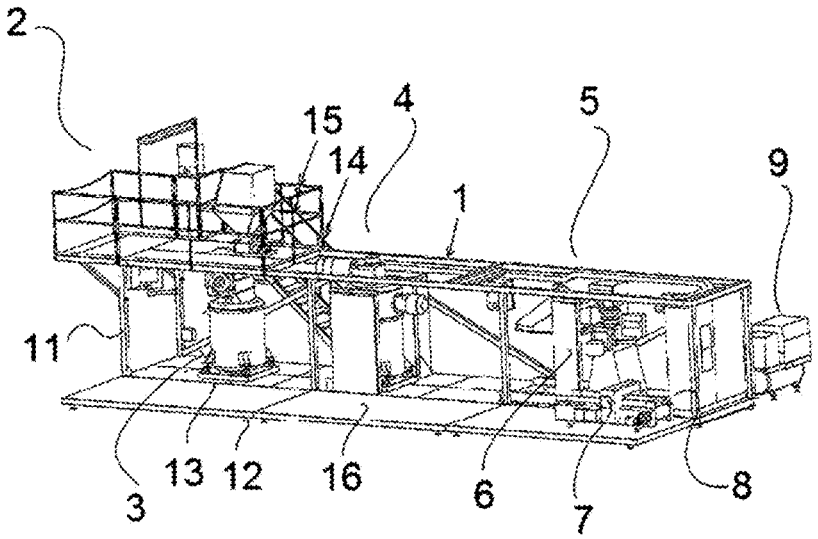
FIG. 1 shows a perspective view of the mobile mixing plant for powdery products and of its carrying structure as described in patent document EP2465780.
Figure 2:
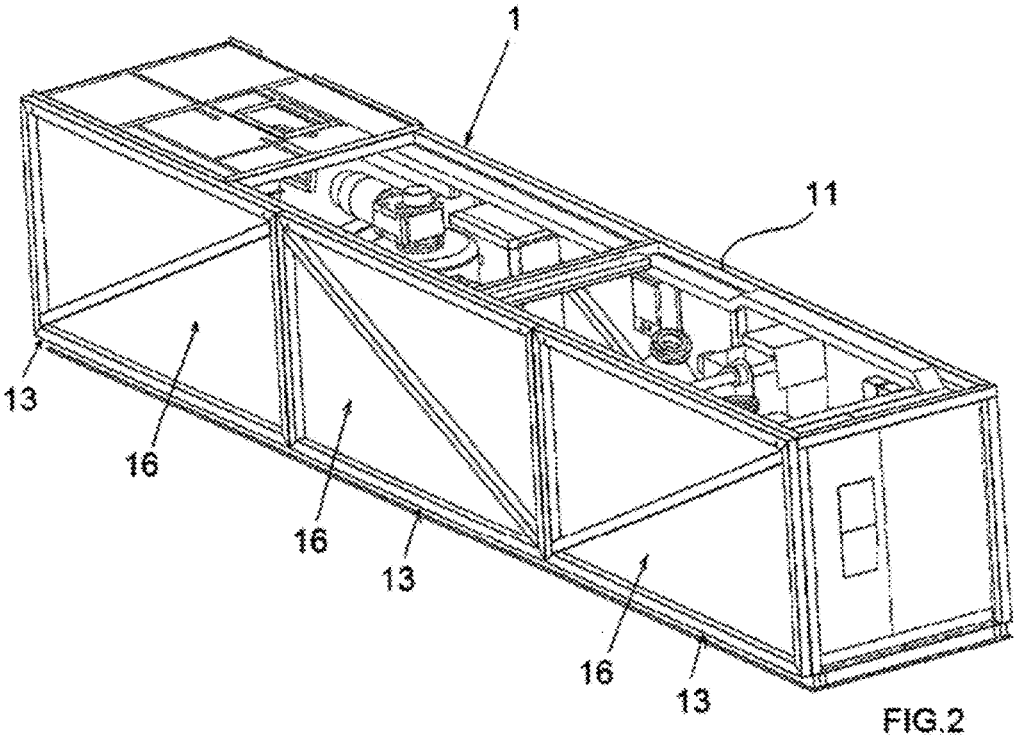
FIG. 2 shows the plant of FIG. 1 in the transport position.
Figure 3A:
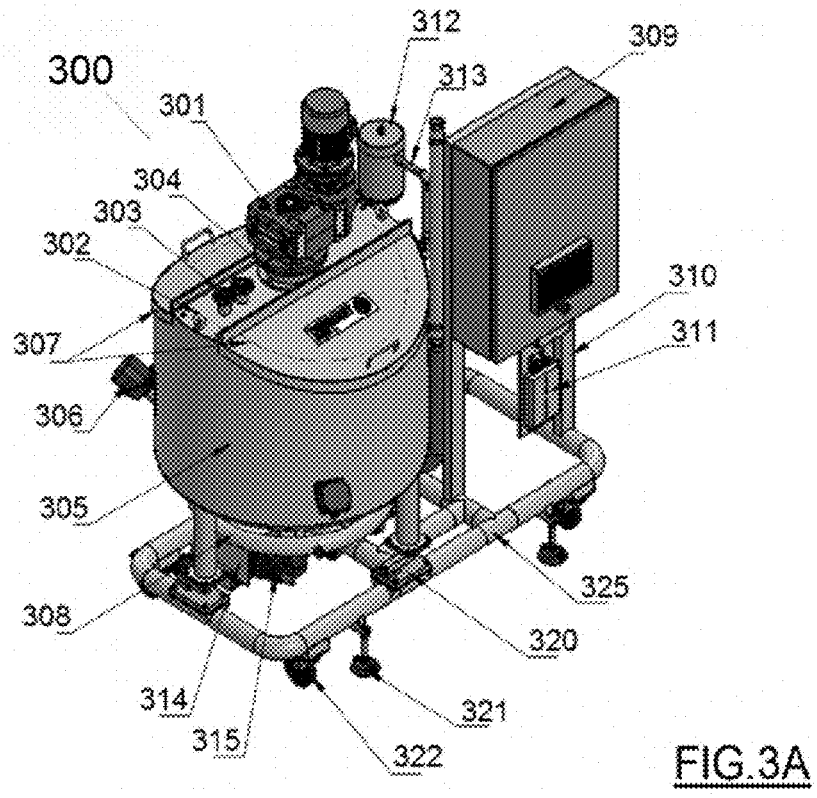
Figure 3E:
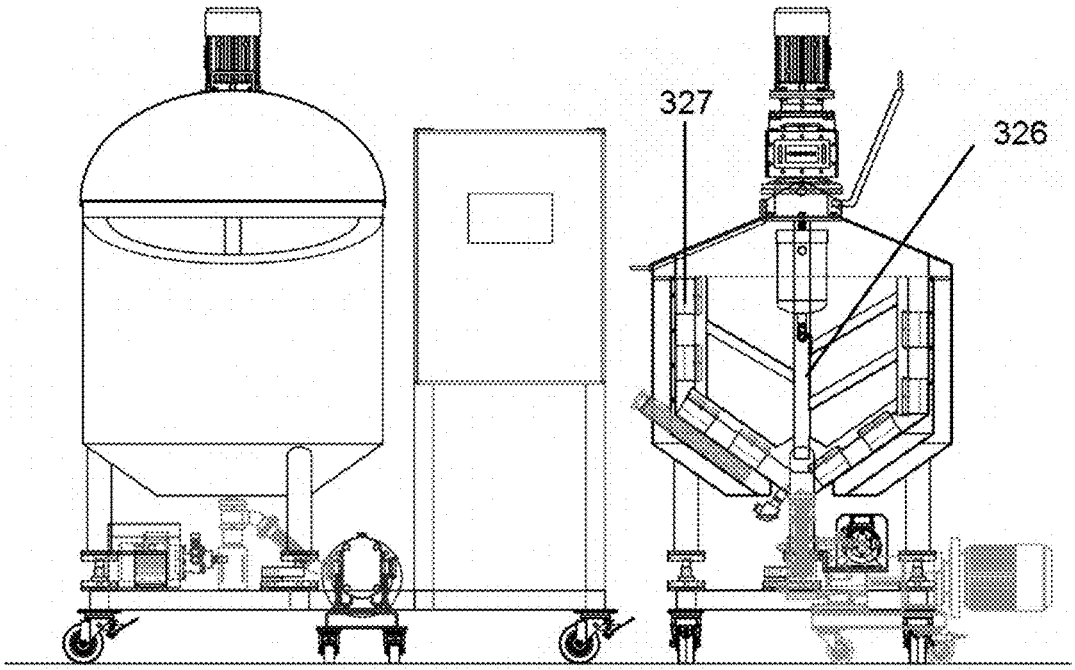

As can be seen in FIG. 1, the modular mobile plant object of the present invention essentially comprises a carrying structure (1) and a receiving and weighing area (2), a loading area (3), a mixing area (4), a packaging area (5), a sewing and labeling area (6), a metal detection area (7), a palletizing area (8) and a cleaning area (9).

The carrying structure (1) is formed by various square tubes (11) supported at several height-adjustable support points (12), several hinges (13) and a set of stairs (14) with a safety railing (15). This structure will have dimensions that are not larger than the measurements of a standard container measuring 40 inches, such that the total dimensions allow the transport thereof in a standard transport container (generally a shipping container measuring 40 feet).

In a practical embodiment, the structure (1) will be built with square stainless steel tube. The ground of the structure will be formed by rolled carbon steel profiles. The profiles and crossbeams of the structure will be made of square stainless steel tube. The structure (1) will be supported by six height-adjustable support points on which there is supported a diamond plate where objects and staff move about. One side (16) will fold in three sections and will also be built with square tube and diamond plate. The aforementioned hinges will fold the aforementioned sides using a number of capstans for easy installation and positioning.

The set of access stairs (14) will be built with stainless steel, except for the tread of the steps, which will also be built from stainless steel anti-skid plate. A rectangle will be arranged at the end of the set of stairs to provide access to the upper part of the platform. The top of the platform and set of access stairs have a protective railing (15) along the entire perimeter, built with square stainless steel tube.

The automatic dosing modules perform dosing prior to introducing the formula and furthermore incorporating an automatic formula loading module with an automatic bag opening system to automate the loading of raw material into the plant. These automatic dosing modules are connected in the receiving and weighing module (2).

Furthermore, the mobile plant also incorporates a liquid injection module for injecting a liquid into a powder mixture (FIGS. 3A-3E), maintaining a final powder state. The module is automated, such that it is possible to automatically dose the liquids into the mixture, up to ten liquids, according to what is previously required by the end user, with the ability to inject up to 50% liquid into the powder such that the powdery form is maintained after the injection with the conditions and parameters required by the final formulation, such as temperature, stirring and pre-mixture of liquids. This liquid injection module is connected with the stirring tank (41) in the mixing module (4).

More specifically, the liquid injection module (300) serves for dosing liquid amounts of any viscosity into the mixer by means of a pump (318), preferably a lobe pump, without ruling out pumps of any other type, where the flow rate is controlled by means of a plurality of loading cells (320). The liquid injection module performs the following phases during the process:

i. Loading the liquid compartment (305) with the liquid or liquids making up the raw material.

ii. Stirring the liquid or liquids by means of an anchor-type agitator and comprising an agitator rotary support (326) and an agitator scraper (327). The liquid compartment (305) maintains or achieves optimal temperatures due to its dual chamber with resistors and temperature control by means of at least one temperature probe (324).

iii. For controlling the amounts to be dosed, the liquid compartment (305) has a plurality of loading cells (320) commanding the pump (318), transferring the exact amounts required for the formula into the stirring tank (41) of the mixing module (4).

The liquids are homogenized by means of the agitator formed by the agitator rotary support (326) and the agitator scrapers (327) because when there is more than one liquid, the exact amount with the same proportion of each ingredient must be previously homogenized and then dosed in that manner. The liquid injection capacity reaches up to a percentage of 50% (it will normally be a lower percentage) with respect to the powder such that the powdery form is maintained after the injection with the conditions and parameters required by the final formulation, such as temperature, stirring and pre-mixture of liquids.

As can be seen in the following table, the liquid injection module (300) comprises the following elements in the particular non-limiting embodiment shown in FIGS. 3A-E:

| Reference | Units | Characteristic |
|---|---|---|
| 301 | 1 | Geared motor |
| 302 | 2 | Lifting loops |
| 303 | 2 | Liquid feed nozzles |
| 304 | 1 | Agitator connection neck |
| 305 | 1 | Liquid compartment |
| 306 | 3 | 3000 W resistors |
| 307 | 2 | Cover of the liquid compartment (305) |
| 308 | 1 | Tubular wiring structure |
| 309 | 1 | Main distribution board |
| 310 | 1 | Rectangular structure for board (309) |
| 311 | 1 | Control of loading cells (320) |
| 312 | 1 | Oil compartment |
| 313 | 1 | Oil circuit |
| 314 | 1 | Gear pump support (315) |
| 315 | 1 | Gear pump of the circuit (313) |
| 316 | 2 | Feed hose |

-continued

| Reference | Units | Characteristic |
|---|---|---|
| 317 | 1 | Bottom valve of tank (305) |
| 318 | 1 | Pump |
| 319 | 1 | Mobile structure of the pump (318) |
| 320 | 3 | Loading cells |
| 321 | 4 | Height-adjustable base |
| 322 | 4 | Wheels of the structure |
| 323 | 1 | Safety sensor |
| 324 | 2 | Temperature probe |
| 325 | 1 | Tubular frame |
| 326 | 1 | Agitator rotary support |
| 327 | 8 | Agitator scraper |

In a particular embodiment, the liquid compartment (305) is a cylindrical type compartment with a frustoconical bottom and dual chamber prepared for introducing thermal oil distributing the heat of resistors (306), which in this particular embodiment have a power of 3 kW each.

The liquid compartment (305) has a hygienic gantry where there is supported an agitator rotary support (326) with agitator scrapers (327) which are made of white, food-grade plastic and withstand service temperatures of 60° C. and peaks of up to 100° C. Furthermore, it comprises at least one cover (307) in the top part making cleaning and inspections easier, furthermore having a certain inclination as shown in FIGS. 3A-3E.

The outlet for the product with a bottom sanitary valve (317). The upper openings will have safety sensors (323) in at least one cover (307). Each of the supports of the liquid compartment (305) has a loading cell (320) that allows reading the weight of the product.

The heating system performs the function of keeping the product at the desired temperature, if necessary, by means of a dual chamber around the liquid compartment (305) in which the thermal oil will circulate and in which the resistors (306) will be installed. The outside of the liquid compartment (305) is insulated.

To load the thermal oil, the equipment has a compartment also acting as an expansion vessel. The oil enters the dual chamber of the tank where it is heated by means of thermal resistors (306). The outlet for the oil is located in the lower part, where there is a gear pump (315) that continuously recirculates the thermal oil while it is hot through the oil circuit (313).

Both the temperature of the product inside the liquid compartment (305) and the temperature of the thermal oil are controlled by temperature probes (324).

The dosing system allows effectively dosing the product contained in the liquid compartment (305) towards the mixing tank (41) of the mixing module of the plant of FIG. 1. Dosing is performed by means of a pump (318) controlled by a variable frequency drive. The inlet of the pump (318) is connected to the bottom valve (317) of the liquid compartment (305) by means of a flexible and hygienic connection. The inlet of the pump (318) is always below the outlet of the bottom valve (317). The outlet of the pump is connected with a feed hose with a connection compatible with an inlet of the mixing tank (41) of the mixing module (4) of the plant of FIG. 1.

Finally, the frame is formed by a tubular structure 325 to prevent flat surfaces and therefore the accumulation of dirt and to make cleaning of all the surfaces easier. The structure incorporates wheels 322 with the possibility of fixing and height-adjustable feet 321 to provide stability to the assembly.

Figure 5A:
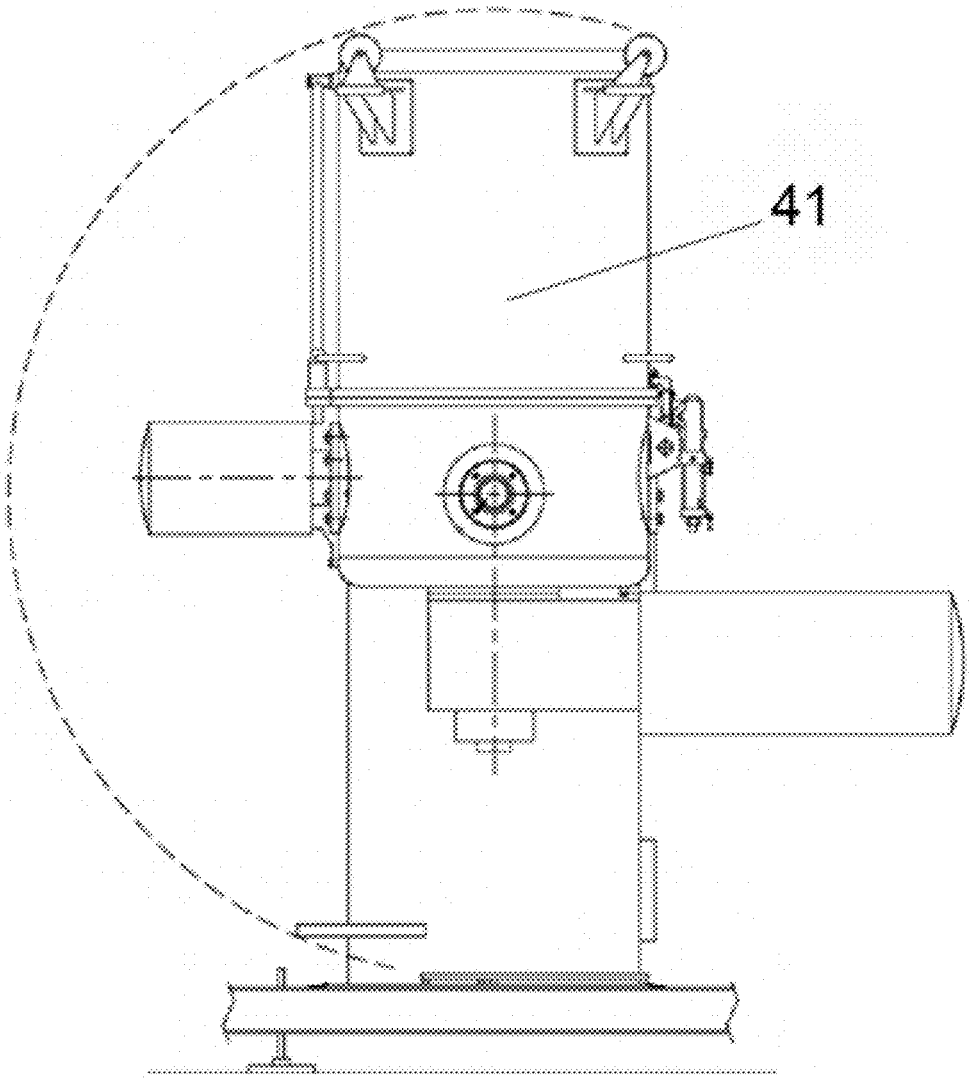
FIGS. 5A-5D show views of the mixing tank (41) of the mixing module (4) in four basic operating positions.
Figure 5B:
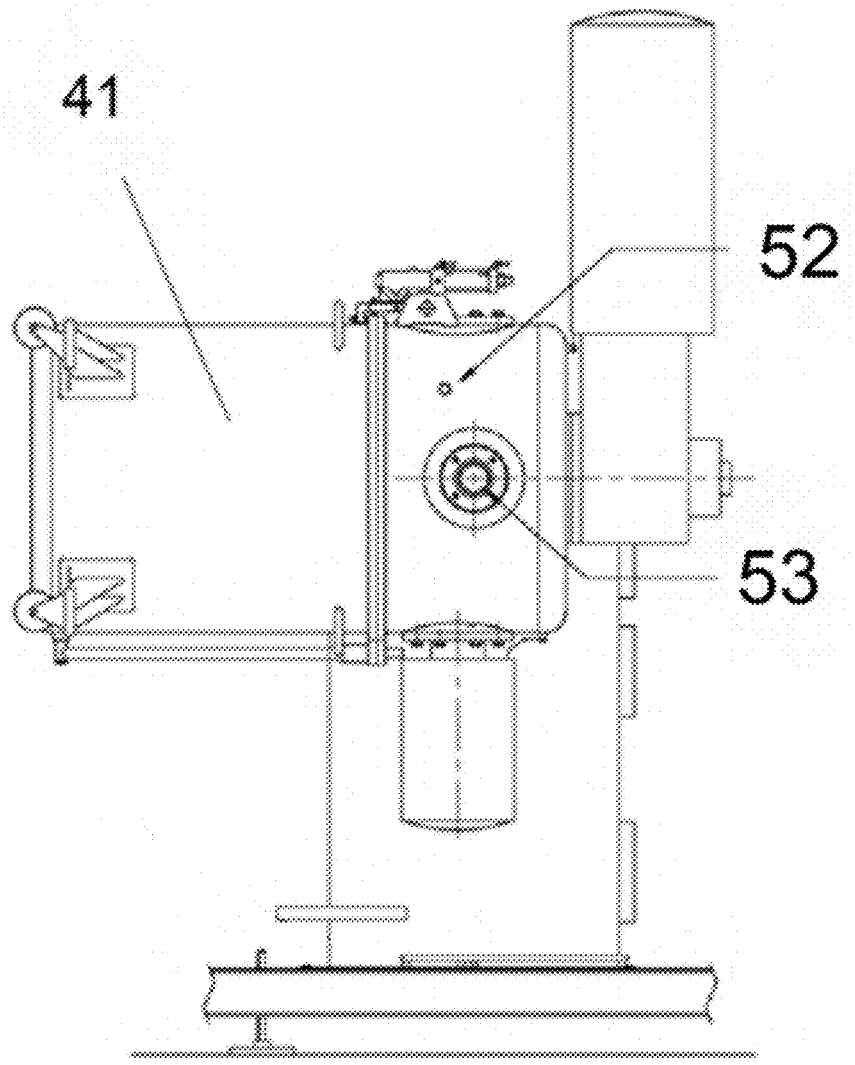
Figure 5C:
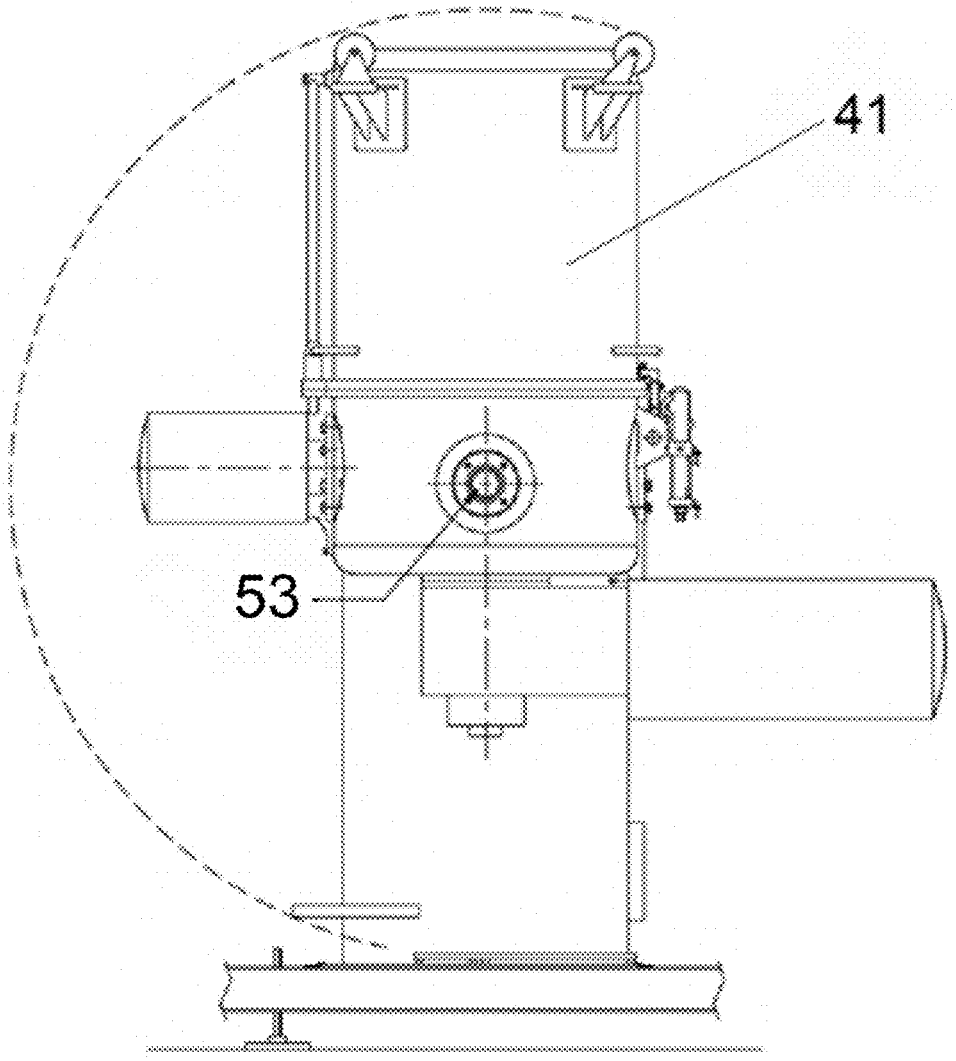
Figure 5D:
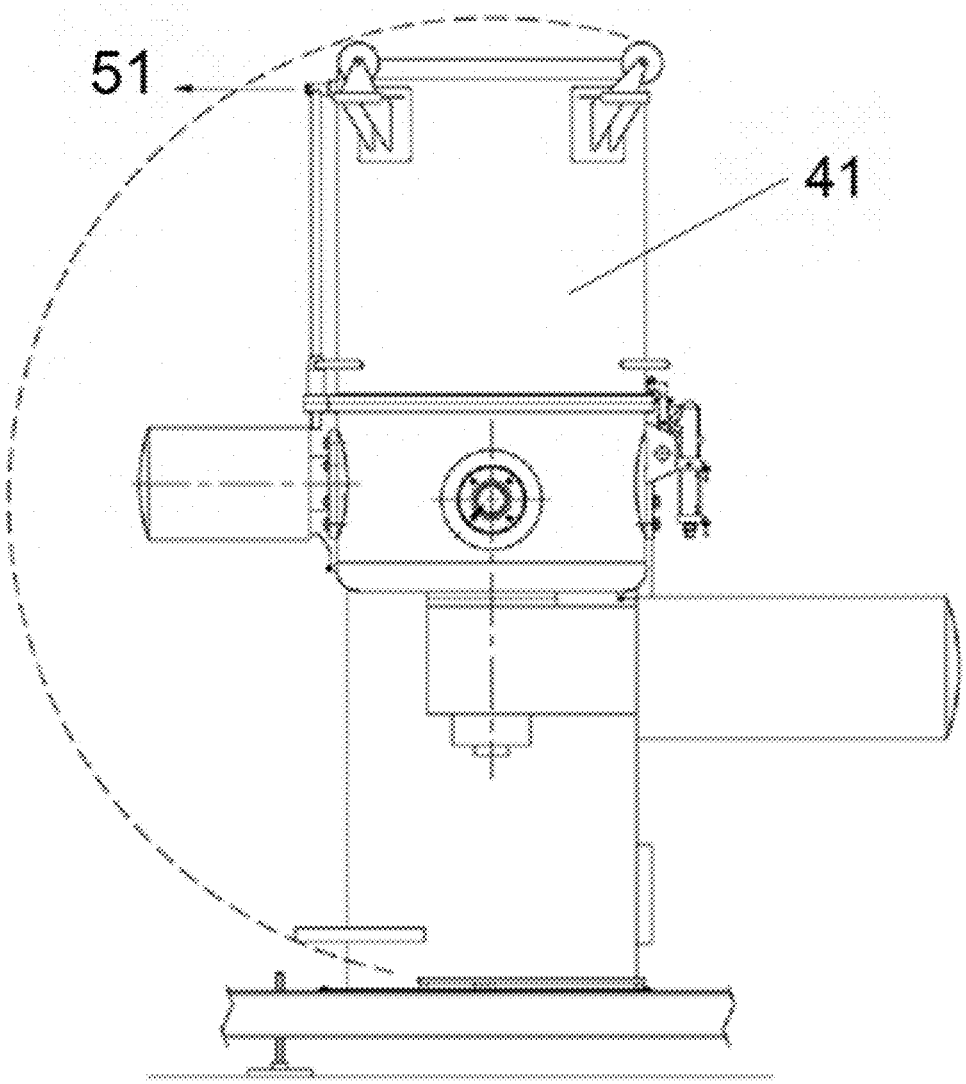

FIGS. 5A-5D show different positions of the mixing tank (41) of the mixing module (4) of the plant of FIG. 1.

a) If in the equipment in the mixing position, for example, its position is rotated +180° (FIG. 5A, i.e., inverting its position with respect to the horizontal defined by the floor of the plant), and a flow of a fluid (for example, dry air) is incorporated, the mixture of solids being processed will be dried. This furthermore makes the mixing tank (41) of the mixing module (4) a fluidized bed dryer by means of drying using air flow, and as indicated, air recirculation in the involute of the lower part of the container.

b) If liquids are injected into the mixing tank (41) with said tank being in the horizontal position (i.e., at an angular position of 90° or of 270° with respect to the horizontal defined by the floor of the plant, or in other words, in a position parallel to the floor of the plant), as shown in FIG. 5B, through a liquid injection inlet (52) and blasts of air are furthermore provided through an air inlet (53) with a specific screen-type agitator as a mixing tool for this new application, creating a suction current at the bottom of container, the so-called pelletizing or granulating operations can be performed.

c) As shown in FIG. 5C, if a mixture of solids with fats having a low melting point is processed in the equipment in which it is necessary to perform the mixture under controlled temperature and humidity conditions (where this operation is very delicate due to the temperature), it can be done by sending a cold fluid stream through the equipment and extracting it through the bottom of the container. The equipment therefore acts as a low-temperature cooler/mixer, even acting as equipment for cooling delicate solids such as fats. In this case, it must be taken into account that not only is the temperature important, but it is also necessary to take into account the humidity conditions of the air that is introduced in the container. Before the air is injected, it is sent through an air handling unit.

d) As shown in FIG. 5D, the equipment can, through an opening in the bottom in a fixed or variable position, connect the outlet of the container to vacuum equipment (51), a vacuum dryer, or it can be subjected to vacuum mixing to prevent possible mixtures, with there being oxygen, which invalidate the mixture. The equipment therefore acts as a vacuum dryer or vacuum mixer.

Finally, the plant incorporates a packaging module depending on the type of packaging required by the end user, including, in a non-limiting manner, a big bag bagging module, a European type bag bagging module or a module for bagging any other type of package (such as sachets, for example). Furthermore, the packaging module can incorporate an automatic palletizing module for that client needing end of line automation.

Figure 4:
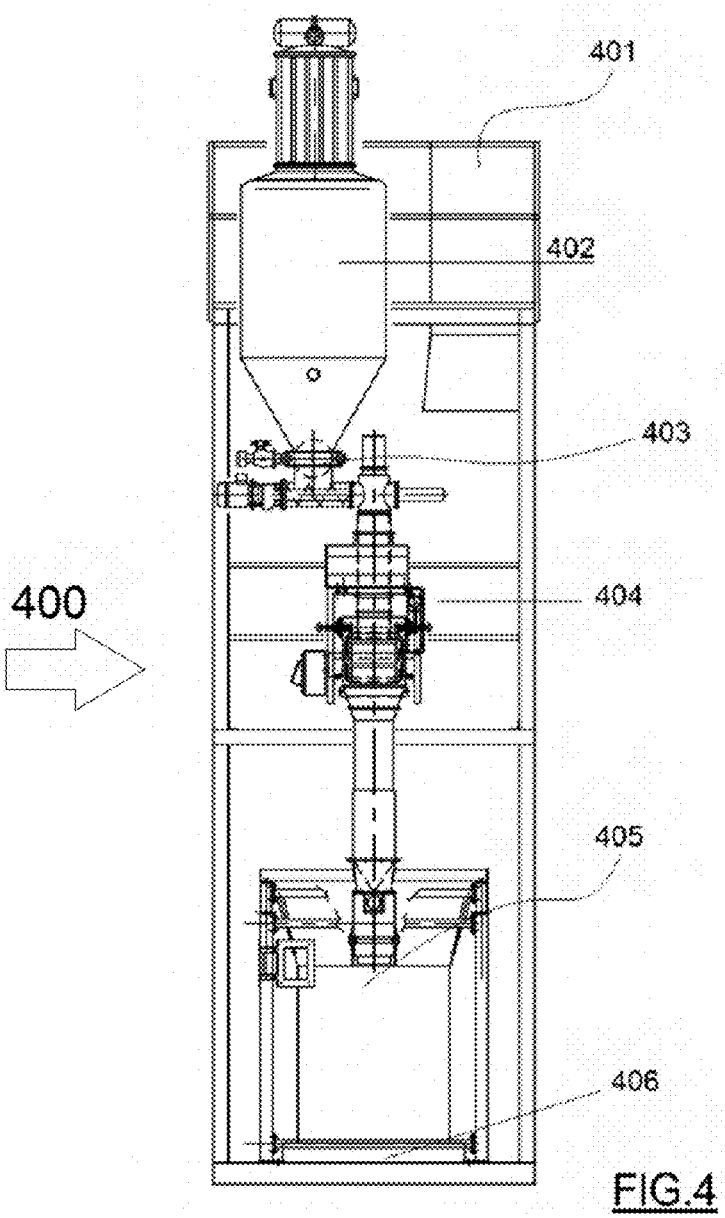
FIG. 4 shows an isolated view of the big bag packaging module that is connected with the mobile mixing plant for powdery products of FIG. 1.

In a particular embodiment, the plant of FIG. 1 for packaging big bags, as can be seen in detail in FIG. 4, allows the packaging module (5) to be able to pack 500 kg to 1000 kg bags. Nevertheless, in some particular embodiments products can be bagged in bags starting from 100 kg, and in some embodiments, also bags of 350 or 400 kg.

The arrangement of this plant is a horizontal container measuring 20 feet which, once at its destination will be installed vertically and will be located after the mixing module (4). The big bag module (400) is made up of three blocks which are placed on top of one another vertically and all the installations are connected with quick connect adaptors without requiring in situ installations, because everything is ready to be assembled and with all installations for starting up in one day. The quick connections and electric power are provided from the general distribution board of the plant of FIG. 1.

Therefore, once the mixing of the product in the mixing module (4) has ended, said product goes to the packaging module (5) which, in this embodiment, comprises a system for taking the powder after mixing to the big bag module (400). The capacity to be achieved is approximately 1000 kg/h, depending on the products.

Packaging is done for four or five 200 kg batches combined with one another. The module is designed to be contained and transported in a 20" open top container with all the necessary machinery, auxiliary elements and tools included. It has been designed to be installed vertically, under cover, protected from the elements, in a ventilated site and located on even ground suitable for the described loads.

This design is established so that it can be divided into three blocks of a height of about 2.3 m each (in any case, less than 2.4 m, which is the maximum height of the containers) and so that they can be handled with an electric fork lift during assembly and installation. Suitable transport and operation is thereby assured, in addition to achieving safety and traceability in the process so that staff working at the plant cannot make mistakes and making it easier to follow the manufacturing sequence as it has been projected, and implementing the necessary surveillance and control means from the central office.

The big bag module (400) comprises the following elements:

(a) A structure (401) capable of being introduced in a 20" container without deformations, protecting and providing support for the different auxiliary machines and equipment for carrying out the different processes.

(b) Receiving the mixed product in a hopper (402) and dosing for packaging.

(c) Dosing valve (403) installed after the hopper (402) for dosing the already mixed product.

(d) In-line metal detector (404) with rejection means.

(e) Batch bagging module (405), with labeling and weight control (406).

The production parameters to be achieved are 1 Tm/h in 4 or 5 batches per bag. The times in the different phases are 12 minutes at most, so said cycle at most will continue to be maintained to assure the indicated capacity. For complete certification and combination with an existing plant of mixtures, in this non-limiting example the times will be (they logically may vary according to the desired installation):

Weighing will be done independently.

Loading.

Taking up bags: 1 min.

Filling: 10 min.

Connection/disconnection: 1 min.

Total: 12 minutes.

Mixing:

Machine connection: 1 min.

Mixing: 10 min.

Disconnection: 1 min.

Total: 12 minutes

Lifting the product from mixing to the feed hopper (402) which complies with cycles that allow the goal of assuring 1000 kg/h Bagging:

Continuously connected with the previous phase, packing must be done with each batch of about 200 kg going through a rotary installation and metal detector until amounting to 4-5 batches, depending on densities.

This operation must be done in 1 hour.

Five container changes (for each batch).

Packaging of these five batches in one bag, going through a rotary installation and metal detector. For each bag, there is weight verification, labeling, and withdrawal of the bag, placing an empty bag to start a new packaging cycle (60 minutes per cycle of 1000 kg for five batches).

Generally, all the general services of the installation will be connected with those of the plant of FIG. 1.

The invention claimed is:

1. A modular mobile mixing and packaging plant for powdery or granular products comprising a carrying structure having dimensions suitable for being introduced in a standard shipping container and internally housing a receiving and manual weighing module, a material loading module, a mixing module, and a packaging module wherein said modules are connected to a control PLC which in turn is connected remotely with a central server arranged for providing the instructions and orders for mixing and configuring the powdery or granular product, wherein the mixing module comprises a mixture tank and means for cooling and/or drying the mixture contained in the mixing module; and wherein the means for cooling and/or drying the mixture are arranged to incorporate an air flow inside the mixing tank by using a plurality of movements of the mixing tank to obtain air recirculation in an involute of a lower part of the mixing tank.

2. The plant according to claim 1 incorporating at least one additional module selected from: an automatic liquid dosing and injection module or a big bag packaging module, wherein said additional modules can be inserted and be connected with the control PLC of the modular plant.

3. The plant according to claim 2, wherein the big bag module comprises: (a) a structure capable of being introduced in a 20" container without deformations; (b) receiving a mixed product in a hopper and dosing for packaging: (c) a dosing valve installed after the hopper for dosing the already mixed product; (d) an in-line metal detector with rejection apparatus; and (e) a batch bagging module, with labeling and weight control.

4. The plant according to claim 2, wherein the liquid injection module is configured for dosing liquid amounts of any viscosity into the mixing tank of the mixing module by means of a pump, with the flow rate thereof being controlled by means of a plurality of loading cells.

5. The plant according to claim 4, wherein dosing is performed by means of a pump such that an inlet is connected to a bottom valve of the liquid compartment;

and wherein the inlet of the pump is always below an outlet of the bottom valve.

6. The plant according to claim 4, wherein the liquid injection module comprises a cylindrical liquid compartment with a frustoconical bottom and dual chamber prepared for introducing thermal oil distributing the heat of thermal resistors.

7. The plant according to claim 6, wherein the cylindrical liquid compartment has a hygienic gantry where there is supported an agitator rotary support with agitator scrapers which are made of white, food-grade plastic and withstand service temperatures of 60° C. and peaks of up to 100° C.

8. The plant according to claim 6, wherein the cylindrical liquid compartment comprises at least one inclined cover in the upper part.

9. The plant according to claim 6, wherein the cylindrical liquid compartment comprises an outlet for the product with a sanitary bottom valve; and wherein upper openings will have safety sensors in at least one cover; and wherein the liquid compartment comprises at least a support including a loading cell that allows reading the weight of the product.

10. The plant according to claim 6, wherein the liquid injection module comprises a heating system that carries out the function of keeping the product at the desired temperature, if required, by means of a dual chamber around the cylindrical liquid compartment in which a thermal oil will circulate and in which thermal resistors will be installed; and wherein the outside of the cylindrical liquid compartment is insulated.

11. The plant according to claim 10, wherein for loading the thermal oil, the liquid injection module has a compartment that also works as an expansion vessel, such that the oil enters a dual chamber of the liquid compartment where it is heated by means of the thermal resistors; and wherein the outlet for the oil is located in the lower part, where there is a gear pump that continuously recirculates the thermal oil while it is hot through the oil circuit.

12. The plant according to claim 6, wherein the temperature of the product inside the cylindrical liquid compartment and the temperature of the thermal oil are controlled by temperature probes.

* * * * *